US006008770A

United States Patent [19]

Sugawara

[11] Patent Number: 6,008,770

[45] Date of Patent: Dec. 28, 1999

[54] PLANAR ANTENNA AND ANTENNA ARRAY

[75] Inventor: Satoru Sugawara, Sendai, Japan

[73] Assignee: Ricoh Company, Ltd., Tokyo, Japan

[21] Appl. No.: 08/870,676

[22] Filed: Jun. 6, 1997

[30] Foreign Application Priority Data

| | | | |
|---|---|---|---|
| Jun. 24, 1996 | [JP] | Japan | 8-181687 |
| Jun. 24, 1996 | [JP] | Japan | 8-181688 |
| Dec. 6, 1996 | [JP] | Japan | 8-340387 |

[51] Int. Cl.[6] ..... H01Q 13/10

[52] U.S. Cl. ..... 343/767; 343/771; 343/786

[58] Field of Search ..... 343/786, 872, 343/873, 767–771, 700 MS; H01Q 13/10

[56] References Cited

U.S. PATENT DOCUMENTS

| | | | |
|---|---|---|---|
| 3,964,070 | 6/1976 | Drabowitch | 343/786 |
| 4,199,764 | 4/1980 | Williams et al. | 343/786 |
| 4,700,190 | 10/1987 | Harrington | 342/2 |
| 4,783,666 | 11/1988 | Ast et al. | 343/872 |
| 4,905,013 | 2/1990 | Reindel | 343/786 |
| 5,081,466 | 1/1992 | Bitter, Jr. | 343/767 |
| 5,408,244 | 4/1995 | Mackenzie | 343/872 |
| 5,519,408 | 5/1996 | Schnetzer | 343/767 |
| 5,661,498 | 8/1997 | Goto et al. | 343/771 |

FOREIGN PATENT DOCUMENTS 5-114810 5/1993 Japan .

OTHER PUBLICATIONS

*R. Janaswamy, et al.,* IEEE Transactions on Microwave Theory and Techniques, vol. MTT–34, No. 8, pp. 900–902, Aug. 1986, "Characteristic Impendance of a Wide Slotline on Low–Permittivity Substrates".

*Pranay R. Acharya, et al.,* IEEE Transactions on Microwave Theory and Techniques, vol. 41, No. 10, pp. 1715–1719, Oct. 1993, "Tapered Slotline Antennas at 802 GHz".

*R. Janaswamy, et al.,* IEEE Transactions on Antennas and Propagation, vol. AP–35, No. 9, pp. 1058–1065, Sep. 1987, "Analysis of the Tapered Slot Antenna".

*Primary Examiner*—Don Wong
*Assistant Examiner*—Hoang Nguyen
*Attorney, Agent, or Firm*—Oblon, Spivak, McClelland, Maier & Neustadt, P.C.

[57] ABSTRACT

A tapered slot plane antenna apparatus for a millimeter wave radio communication system which provides a tapered pattern composed by utilizing a Fermi-Diac distribution function so as to consider an impedance matching and a directivity of the antenna apparatus. Supporting layers and protection layers may be utilized to provide sufficient strength for implementation in a compact millimeter wave radio communication system. The plane antenna may further prevent a directivity from deteriorating even if distances between end portions of an antenna aperture portion and ends of an antenna are decreased. A slot width of a slot line may be widened in tapering for radiating an electromagnetic wave in a progressive direction of the slot line by a conductor portion having a slot line and a corrugated structure portion at respective end portions located parallel to a radiating direction of the electromagnetic wave.

19 Claims, 15 Drawing Sheets

PLANAR ANTENNA AND ANTENNA ARRAY

BACKGROUND OF THE INVENTION

1. Field of the Invention

The present invention relates to a planar antenna and an antenna array applicable to mobile communication equipment, a compact information terminal and other radio devices containing a planar antenna, and which may also be used in an application of millimeter wave communication, such as a wireless local area network (LAN).

2. Description of the Background

According to the development of technology, there has been an increase in the use of millimeter-wave communication systems, such as a portable product for a wireless local area network (LAN), a movable communication apparatus, millimeter-wave imaging arrays for remote sensing, radio astronomy, plasma measurement, etc. These apparatuses provide for using high frequency radiowaves with wavelengths in a range of a millimeter or submillimeter. For example, such systems may be used in approximately a 60 GHz frequency range. As a result of these communication systems which use a high frequency range, there is interest in a planar antenna element. A planar antenna is able to be designed to be compact for planning such communication systems. Furthermore, a planar antenna is easy for integrating with other planar devices of electric circuits, such as a high frequency electric circuit of a receiver or a transmitter. Therefore, a planar antenna may be used in many applications including a portable product for a wireless LAN system, or a movable communication apparatus, and so on. A tapered slot antenna is one of a typical implementation of a planar antenna.

A tapered slot antenna in one form of a plane antenna is provided with a structure in which a slot width of a slot line is widened by inclining (tapering), wherein an electromagnetic wave is radiated in a direction parallel to an antenna surface (in a progressive direction of the slot line). Since a tapered slot antenna has a same structure as the slot line, a tapered slot antenna does not need a ground conductor on a back surface thereof in a same way as a microstrip line. Accordingly, a tapered slot antenna can be easily integrated with a feeder and a matching circuit having a uniplanar structure. Hereinafter, a tapered slot antenna is simply referred to as a plane or planar antenna.

In applications of millimeter-wave integrated circuits, if it is not possible to provide an impedance matching of an antenna apparatus, a power of radiowaves is decreased through the antenna element so as to be reflected either during a radiating or a receiving period. Therefore, the antenna apparatus has to consider impedance matching which provides sufficient characteristics for high efficiency of millimeter-wave communication.

Examples of background tapered slot antennas are disclosed in "The Tapered Slot Antenna—A New Integrated Element for Millimeter-Wave Applications" by K. S. Yngvesson et al, IEEE TRANSACTIONS ON MICROWAVE THEORY AND TECHNIQUES, Vol. 37, No. 2, February 1989.

This disclosure recites several tapered slot antenna apparatuses which have taper patterns which are relatively simple for implementation. For example, a "Vivaldi" which has an exponential taper pattern, a "LTSA" which has a linear taper pattern, and a "CWSA" which provides a constant width near an aperture portion of the slot pattern, are described therein. However, considering a millimeter-wave communication system, such as using a high frequency of 60 GHz, these tapered slot antennas are hard to implement in a compact structure since a length of the slot is almost three or four wavelengths long. These disclosed patterns of a tapered slot would not be able to provide sufficient characteristics for directivity in a short length of the slots.

Although a tapered slot antenna apparatus has just a one dimensional structure in a direction of wave radiation, a tapered slot antenna apparatus is known to radiate radiowaves which has nearly a circular shape with sufficient directivity in millimeter wave communication apparatuses. For radiating nearly circular waves in a millimeter wave communication apparatuses, a thickness of the antenna substrate would be configured in a range described by the following expression which is derived experimentally:

$$\frac{0.005\lambda}{\sqrt{\varepsilon}-1} \le t \le \frac{0.03\lambda}{\sqrt{\varepsilon}-1}$$

wherein $\epsilon$ is a dielectric ratio of a material which composes the antenna substrate, t is a thickness of the antenna substrate, and $\lambda$ is a wavelength in a vacuum.

However, according to the above referenced expression, a thickness of an ideal antenna substrate would be less than 0.1 millimeter when the tapered slot antenna radiates a radiowave which is approximately at 60 GHz of frequency. Consequently, in this planning of a thickness of a tapered slot antenna, it is too thin to provide a sufficient mechanical strength for implementing with a millimeter wave communication apparatus.

Furthermore, if another dielectric device is in a neighborhood of the tapered slot antenna apparatus, characteristics of the antenna apparatus deteriorate because of a dielectric loss of the antenna circuit. Therefore, in a case of implementation, the antenna apparatus would be provided with some spatial separation in a neighborhood of the antenna apparatus thereof. This provides another problem for implementing and integrating a millimeter-wave communication system.

SUMMARY OF THE INVENTION

Accordingly, one object of the present invention is to provide a novel tapered slot antenna apparatus with an efficient and improved structure for implementing a compact millimeter wave communication apparatus.

A further object of the present invention is to provide a novel tapered slot antenna apparatus which improves a radiation pattern so as to consider an impedance matching and a sufficient directivity for millimeter-wave communication.

A further object of the present invention is to provide a novel tapered slot antenna apparatus which is composed by using an easy expression for implementation so as to provide improved efficiency for millimeter-wave communication.

A further object of the present invention is to provide sufficient mechanical strength for a structure of a novel tapered slot antenna apparatus which could implement a compact millimeter-wave communication apparatus.

A further object of the present invention is to provide sufficient efficiency for a novel tapered slot antenna apparatus when implemented and integrated in a compact millimeter-wave communication apparatus.

A further object of the present invention to provide a novel planar antenna which has a directivity which is not deteriorated, even if distances between end portions of the antenna aperture portion and ends of the antenna are reduced.

A further object of the present invention is to provide a novel planar antenna array which does not deteriorate characteristics of each planar antenna even if the distances between respective planar antennas constituting the antenna array is shortened so that respective antennas are adjacent to each other.

In one embodiment of the present invention, a tapered slot antenna apparatus radiates or receives millimeter waves and includes a tapered pattern composed by using a Fermi-Dirac function. An antenna layer provides for a film-shaped structure composed by a conductive material and a dielectric material. The tapered pattern based on a Fermi-Dirac function provides for the antenna layer which provides an impedance matching and a directivity for millimeter wave radio communication.

Supporting layers can be provided for sandwiching an upper plane and a lower plane of the antenna layer. The supporting layers may be composed by a dielectric material which has a relatively lower dielectric ratio compared with the antenna layer. Protection layers may also be provided for sandwiching an upper plane and a lower plane of the antenna layer and the supporting layers. The protection layers may be composed by a relatively hard material compared with the antenna layer and the supporting layers so as to provide a sufficient strength for a structure of the tapered slot antenna apparatus. The protection layers also provide for forming a neighborhood space for the antenna layer when implemented and integrated in a millimeter wave radio communication apparatus therein.

Further, although the reason has not been clearly understood for the fact that distances between end portions of an antenna aperture portion of a planar antenna and ends of the antenna are required to have an approximately $2\lambda$ length, it is considered as follows.

A tapered slot antenna is one of a traveling wave type. As an electromagnetic wave propagating on the slot line is transmitted in a tapered portion, a slot line mode is transformed into a free space mode. In this process, in order to compensate for a discontinuity between the above two modes, a surface mode is induced. If distances between the end portions of the antenna aperture portion and the ends of the antenna are sufficiently long, the surface wave is simply transmitted in a direction spaced away from the antenna. Accordingly, a resultant influence can be ignored. On the other hand, if the distances between the end portions of the antenna aperture portions and the ends of the antenna are short, the surface wave is reflected at the end portions of the antenna, and the reflected surface wave returns to the antenna portions, whereby the surface wave re-interacts with the electromagnetic wave transmitting in the slot line and free space. In such a manner, the shorter the distances between the end portions of the antenna aperture portions and the ends of the antenna, the stronger the strength of the surface wave which is reflected at the antenna ends. Accordingly, it is considered that the antenna characteristics of the planar antenna are deteriorated.

Accordingly, a further object of the present invention is to overcome this reflecting phenomena.

To achieve this further object, if a strength of a surface wave which is reflected at the ends of the antenna is reduced, the antenna characteristics are preferably preserved when the distances between the end portions of the antenna aperture portion and the ends of the antenna are decreased. By utilizing the wave property of the surface wave, a plurality of waves reflected at the antenna end are superimposed on each other in such a manner that one part of the reflected wave has a phase difference of approximately $\pi$, so that the reflected waves off set each other.

According to an aspect of the present invention, there is provided a plane antenna having a structure in which a slot width of a slot line is widened in tapering for radiating an electromagnetic wave in a progressive direction of the slot line by including a conductor portion having a slot line and a corrugated structure at respective end portions located parallel to a radiating direction of the electromagnetic wave.

According to another aspect of the present invention, there is provided an antenna array provided with, on a same plane, a plurality of plane antennas having a structure in which a slot width of a slot line is widened in tapering for radiating an electromagnetic wave in a progressive direction of the slot line by including a conductor portion having a plurality of slot lines and a slit in which a corrugated structure is disposed between each of the slot lines.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
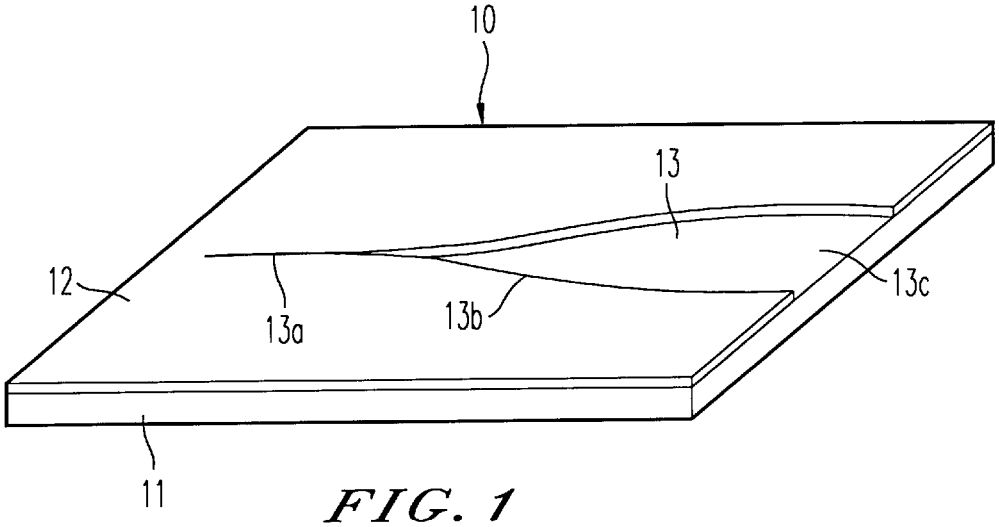
FIG. 1 is a slant plan view of an implemented embodiment of the present invention.

Hereinafter, a plane antenna and an array antenna according to the present invention will be described in detail with reference to the accompanying drawings, wherein like reference numerals designate identical or corresponding parts throughout the several views.

The present invention may be implemented as part of a millimeter-wave communication apparatus, such as a transmitter or a receiver in wireless LAN systems. In the following description, specific details of tapered slot antenna elements are set forth in order to provide a through understanding of the present invention. It will be apparent, however, to one skilled in the art that the present invention may be practiced without such specific details. In other instances, conventional components of wireless LAN systems, for example an architecture of a transmitter or receiver, have not been shown in detail in order to not unnecessarily obscure the present invention.

FIG. 1 illustrates a slant view of a tapered slot antenna element 10 as an implemented embodiment of the present invention. A tapered slot antenna element 10 provides an antenna substrate 11 of a dielectric material, such as polyimide. An electric conduction layer 12 is composed on the antenna substrate 11. A tapered slot pattern 13 is fabricated on the electric conduction layer 12 by eliminating the electric conduction layer 12 thereof. An etching process can be provided for this elimination. The tapered slot pattern 13 provides for radiating and/or receiving radiowaves.

Figure 5:
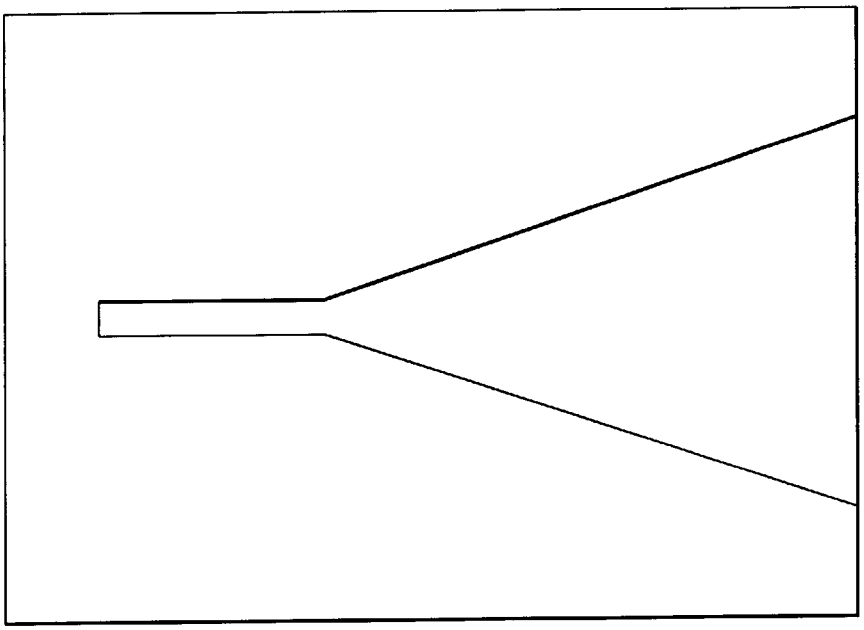
FIG. 5 BACKGROUND ART
FIG. 5 is a vertical plan view of a background tapered pattern of a tapered slot antenna element.
Figure 6:
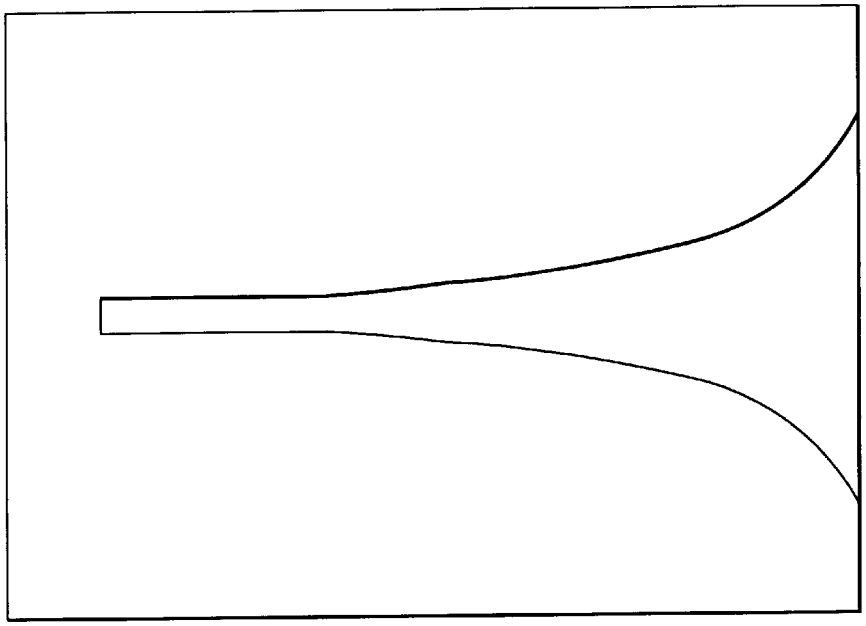
FIG. 6 BACKGROUND ART
FIG. 6 is a vertical plan view of a background tapered pattern of a tapered slot antenna element.
Figure 7:
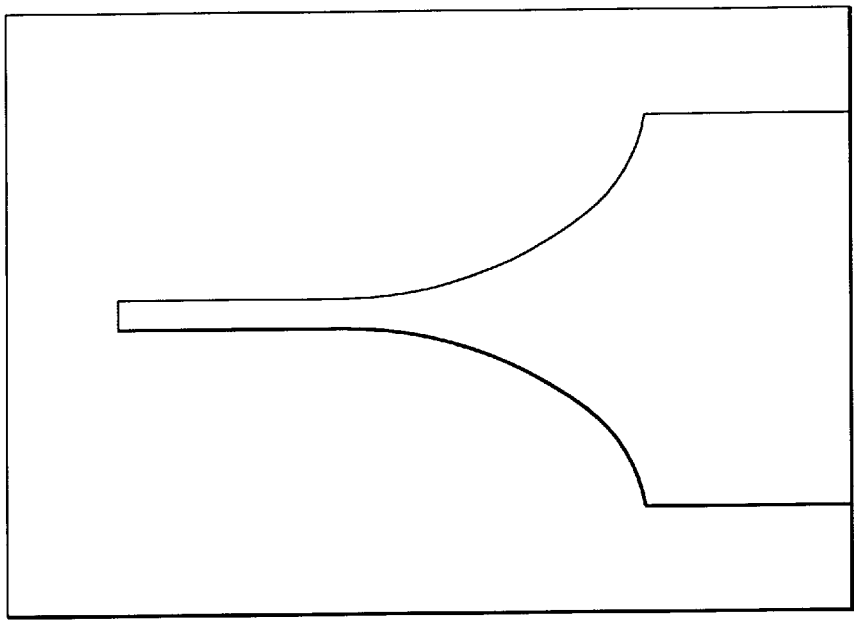
FIG. 7 BACKGROUND ART
FIG. 7 is a vertical plan view of a background tapered pattern of a tapered slot antenna element.
Figure 8:
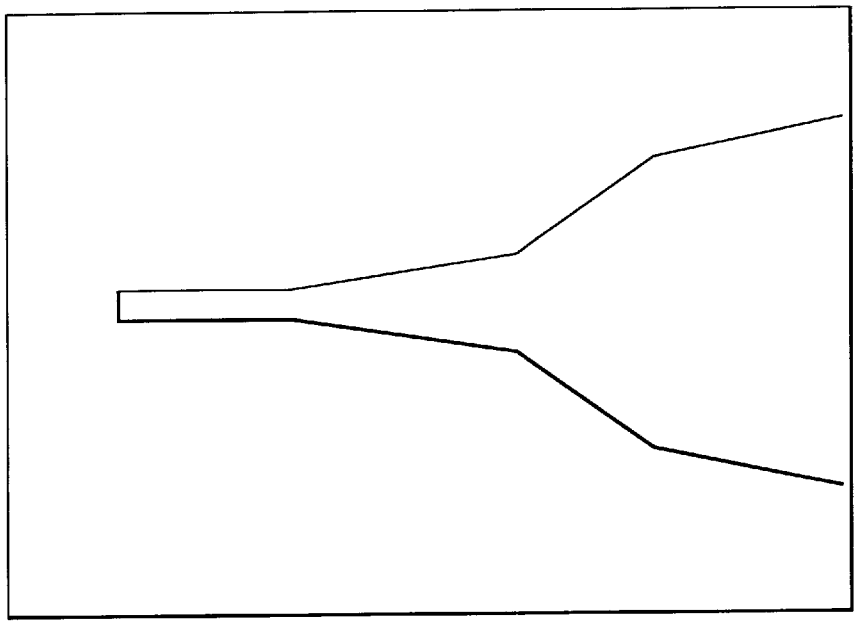
FIG. 8 BACKGROUND ART
FIG. 8 is a vertical plan view of a background tapered pattern of a tapered slot antenna element.

When considering impedance matching, a tapered pattern 13 of the antenna element 10 would be suitable for a pattern which is continuously successive. For example, a continuously successive pattern would be represented by a linear taper, such as an "LTSA" as shown in FIG. 5, or an exponential taper, such as a "Vivaldi" type as shown in FIG. 6. However, in considering mainly about directivity, the tapered pattern 13 would be suitable for a concentrated pattern. For example, one concentrated pattern would be represented by a "CWSA" (Constant Width Slot Antenna) as shown in FIG. 7 or a "BLTSA" (Broken Linearly Tapered Slot Antenna) as shown in FIG. 8, which have a relatively wide aperture at a taper pattern, and which have a narrow shaped pattern end. Although such concentrated patterns are not continuously successive, it looks like grasping or wrapping in accordance with the radiation wave surface.

Figure 2:
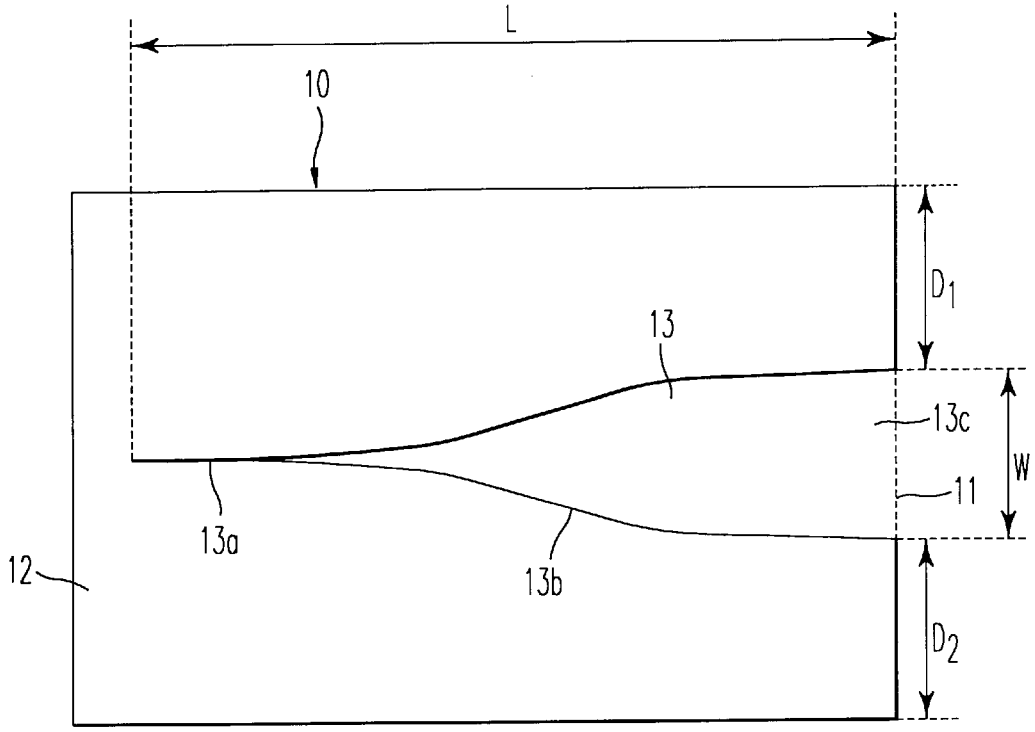
FIG. 2 is a plan vertical view of an implemented embodiment of the present invention.

FIG. 2 shows a vertical view of the tapered slot pattern 13 of the embodiment shown in FIG. 1. The tapered pattern 13 provides a narrow primary portion 13*a*, a gradually successive portion 13*b*, and a wide aperture portion 13*c*. The tapered pattern 13 is represented by using an exponential function so as to be compatible in characteristics of directivity and impedance matching of the "CWSA" type. The tapered pattern is described by the following function:

$$y = \frac{a}{1 + e^{bx+c}}$$

wherein x is a variable which represents position coordinates in a radiation direction of the antenna apparatus, and a, b, and c are predetermined constants.

This function is a Fermi-Dirac function which is frequently used in the field of solid state physics.

Favorably, one embodiment of the present invention is for a frequency range of 60 GHz, wherein the above constants provided are "a"=2.5 mm, "b"=0.5 $mm^{-1}$, and "c"=−5. The tapered slot antenna element 10 can, as an example, be fabricated on a copper-clad polyimide film with a thickness of 0.05 mm and which has a dielectric ratio 3.6. The electric conduction layer 12 may be composed from copper. A thickness of the electric conduction layer 12 may be 0.005 mm which is provided on one side of the antenna substrate 11. A length of the tapered slot pattern 13, that is "L", may be 20 mm, which would be about four times a wavelength. An aperture of the slot of the antenna "W" may be 5 mm, that is, about a wavelength, and distances from the aperture edges to the substrate, that is "$D_1$" and "$D_2$", may be 10 mm, or about two times a wavelength.

The copper-clad polyimide film would be one type of an appropriate material for fabricating the tapered slot antenna element 10. Such a polyimide film is not easily cracked, even if formed of a sufficiently thin structure for considering a thickness of the antenna substrate for use with a millimeter wavelength electromagnetic wave. Furthermore, such a polyimide film provides a small dielectric loss for implementing the tapered slot antenna apparatus. However, the material of the antenna substrate could be another material with similar considerations of strength in a sufficiently thin structure and small dielectric ratio thereof.

Figure 3:
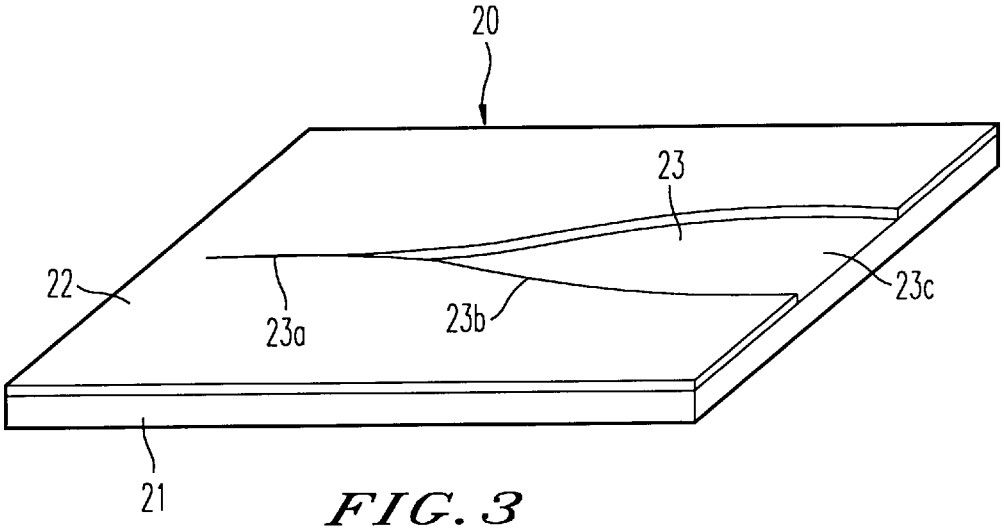
FIG. 3 is a slant plan view of a further implemented embodiment of the present invention.
Figure 4:
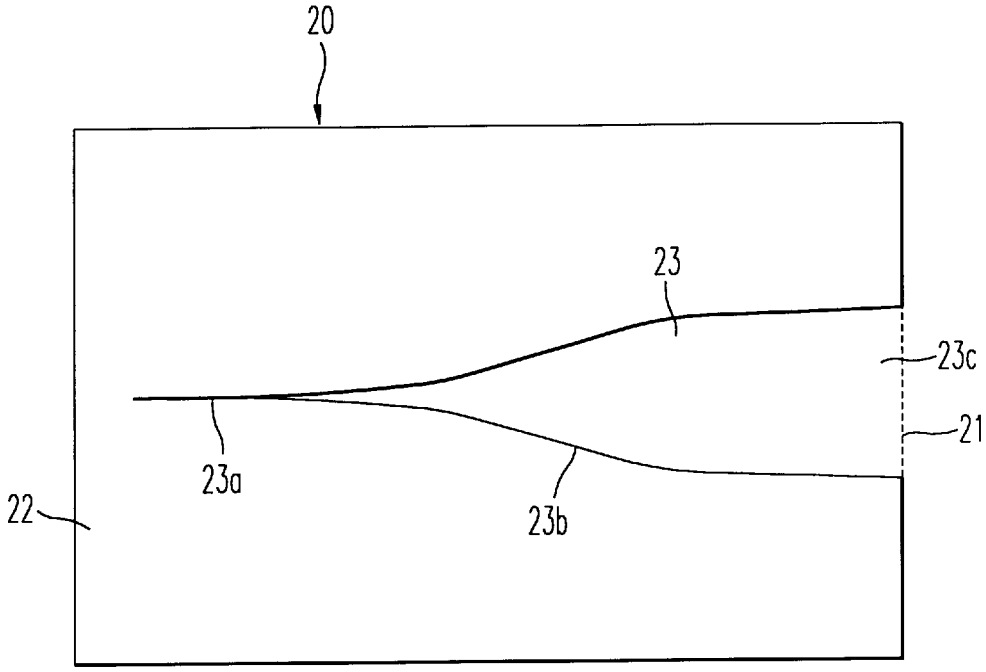
FIG. 4 is a vertical plan view of a further implemented embodiment of the present invention.

FIGS. 3 and 4 describe a further embodiment of a tapered slot antenna 20. FIG. 3 shows a slant view and FIG. 4 shows a vertical view of this further embodiment. In this further embodiment, a tapered pattern 23 also provides a narrow primary portion 23*a*, a gradually successive portion 23*b*, and a wide aperture portion 23*c*. However, the tapered pattern 23 is represented based on another exponential function, and has a relatively linear shape compared with the embodiment of FIGS. 1 and 2. The tapered pattern 23 provides for improving a pattern of the "BLTSA" type so as to provide a characteristic of directivity and impedance matching compatibly. The tapered pattern is described by the following expression, which is also a kind of the Fermi-Dirac function:

$$y = \frac{a}{1 + e^{bx+c}} + dx$$

wherein x is a variable of position coordinates in a radiation direction of the antenna apparatus, and a, b, c, and d are predetermined constants.

This further embodiment of the present invention of FIGS. 3 and 4 can be utilized in a frequency range of 60 GHZ, wherein the above constants are "a"=1.475 mm, "b"=−0.5 $mm^{-1}$, "c"=−5, and "d"=0.05. The tapered slot antenna element 20 may be fabricated on a copper-clad polyimide film with a thickness of 0.05 mm and having a dielectric ratio 3.6. The electric conduction layer 22 may be composed from copper. A thickness of the electric conduction layer 22 may be 0.005 mm which is provided on one side of the antenna substrate 21. A length of the tapered slot pattern 23, that is "L", may be 20 mm or be about four times as long as a wavelength. An aperture of the slot of the antenna "W" may be 5 mm, that is, about a wavelength, and distances from an aperture edge to the substrate, that is "$D_1$" and "$D_2$", may be 10 mm, or about two times a wavelength.

Figure 9:
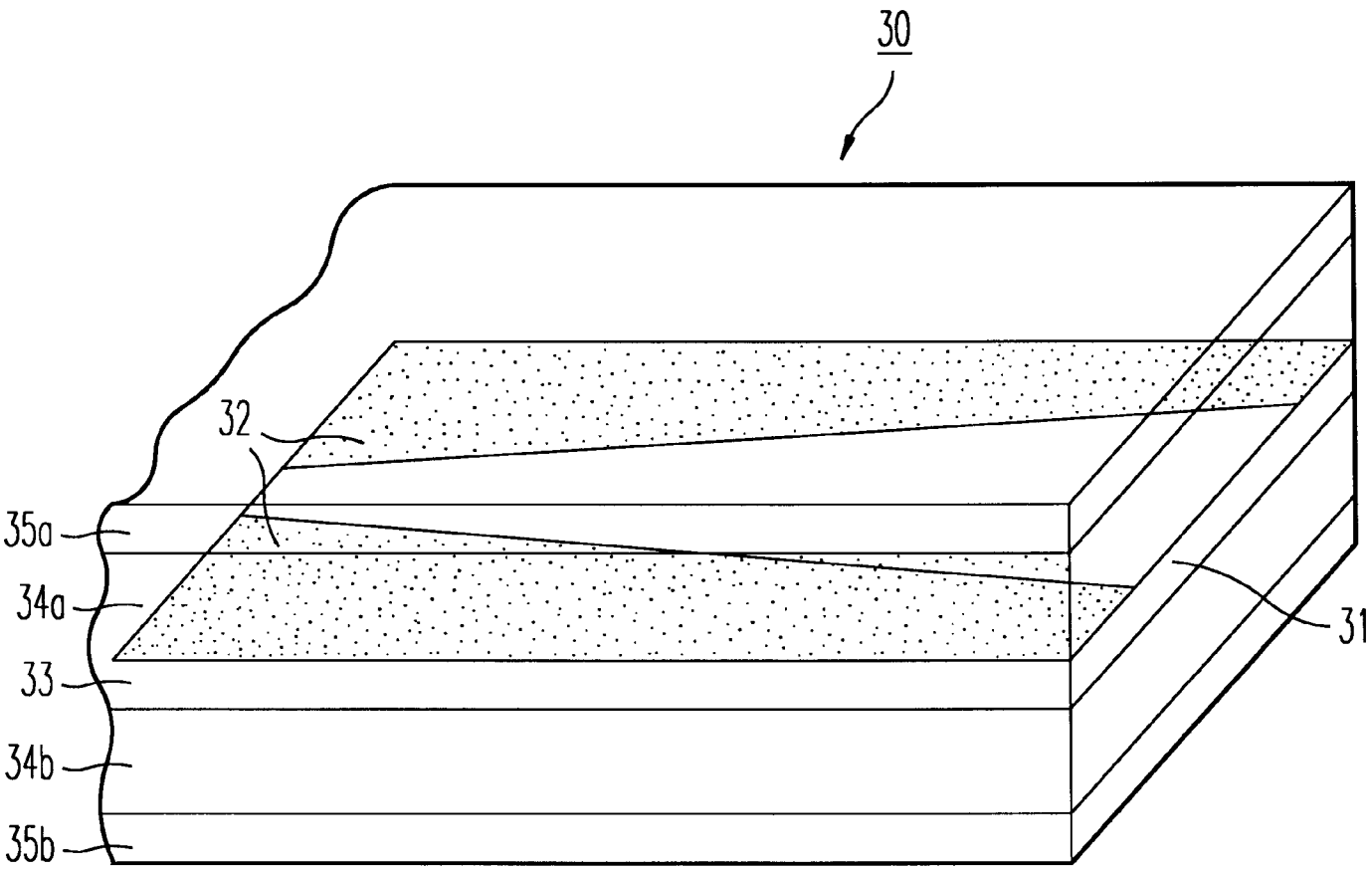
FIG. 9 is a cross section slant view of another implemented embodiment of the present invention.

FIG. 9 shows a cross section slant view of another implemented embodiment of the present invention. This embodiment provides a sufficiently strong structure for implementing a compact millimeter-wave communication application. As shown in FIG. 9, a planar antenna apparatus 30 includes an antenna layer 33. The antenna layer 33 is provided by an antenna substrate 31 and a conduction layer 32. The conduction layer 32 provides a tapered slot pattern for radiating and/or receiving millimeter waves. The antenna layer 33 may be fabricated on a copper-clad polyimide film with a thickness of 0.05 mm. That is, the antenna substrate 31 may be composed by polyimide and the electric conduction layer 32 may be composed by copper. The electric conduction layer 32 is provided for covering one side of the antenna substrate 31 and may have a thickness of 0.005 mm. The copper-clad polyimide film is a suitable material for composing the antenna layer 33 as it provides a sufficiently thin structure for the millimeter wave application, such as utilization for a 60 GHz frequency radiowave. Furthermore, it provides a small dielectric deterioration for the antenna characteristic, and is not easily cracked when implemented as the antenna layer 33.

Although the tapered pattern of the antenna apparatus shown in FIG. 9 is described as a linear shape, the antenna apparatus could also adopt a tapered pattern using a Fermi-Dirac function as shown in FIGS. 1, 2, 3, and 4 for implementing and integrating an antenna apparatus in this embodiment.

Supporting layers 34*a* and 34*b* are provided for sandwiching the antenna layer 33 between an upper plane and a lower plane of the antenna layer 33. The supporting layers 34 may be composed of dielectric materials which have a lower dielectric ratio compared with the antenna substrate 31. For example, the supporting layers 34*a* and 34*b* may be composed by a foamed polyethylene material having a thickness of 3 mm. Foamed polyethylene has a sufficiently low dielectric ratio. Accordingly, the supporting layers 34*a* and 34*b* can be provided with a sufficiently small dielectric loss which would not deteriorate the antenna characteristics.

Furthermore, protection layers 35*a* and 35*b* are provided for sandwiching the antenna layer 33 and the supporting layers 34*a*, 34*b*. The protection layers 35*a*, 35*b* may be composed by dielectric materials which have a relatively hard structure compared with the antenna layer 33 and the supporting layers 34*a*, 34*b*. For example, the protection layers 35*a* and 35*b* may be composed of Teflon having a thickness of 1 mm. Accordingly, the protection layers 35*a*, 35*b* can be provided with a sufficiently hard structure and small dielectric loss which would not deteriorate the antenna characteristics. Therefore, the protection layers 35*a* and 35*b* provide sufficient mechanical strength for implementing the tapered slot antenna apparatus 30 in a compact structure.

Figure 10:
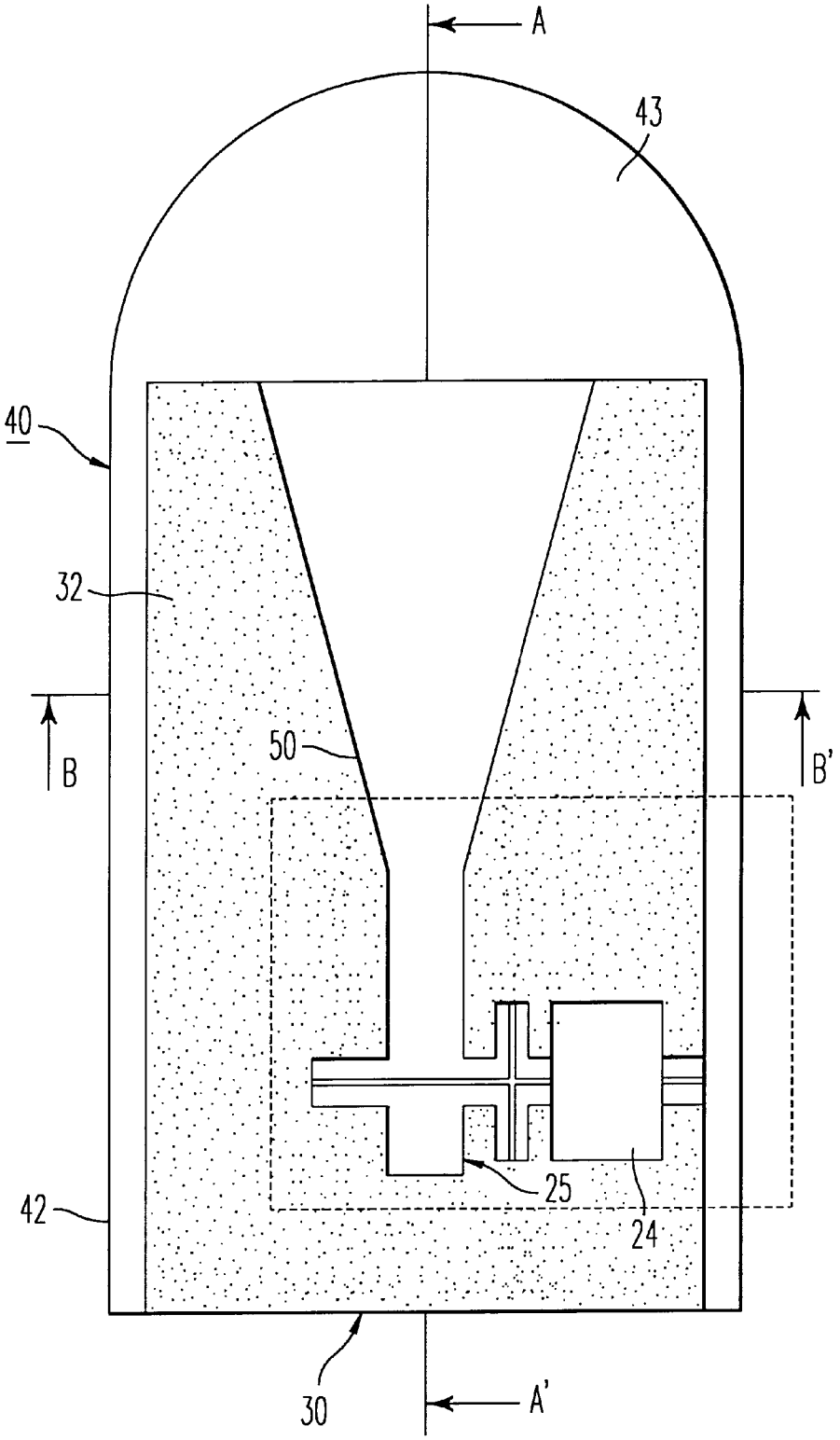
FIG. 10 is a vertical plan view of another implemented embodiment of the present invention.
Figure 11:
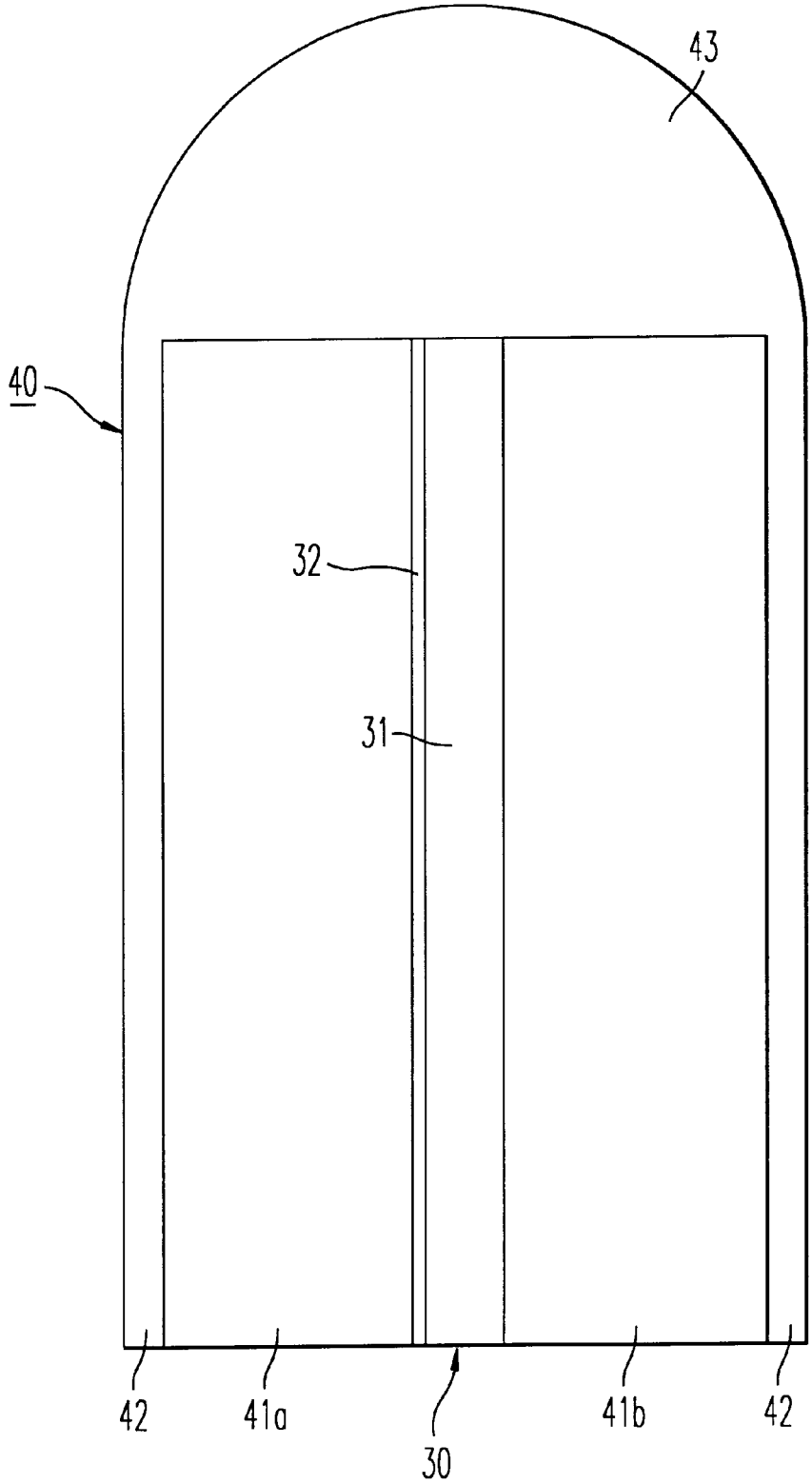
FIG. 11 is a horizontal plan view of the implemented embodiment shown in FIG. 10.
Figure 12:
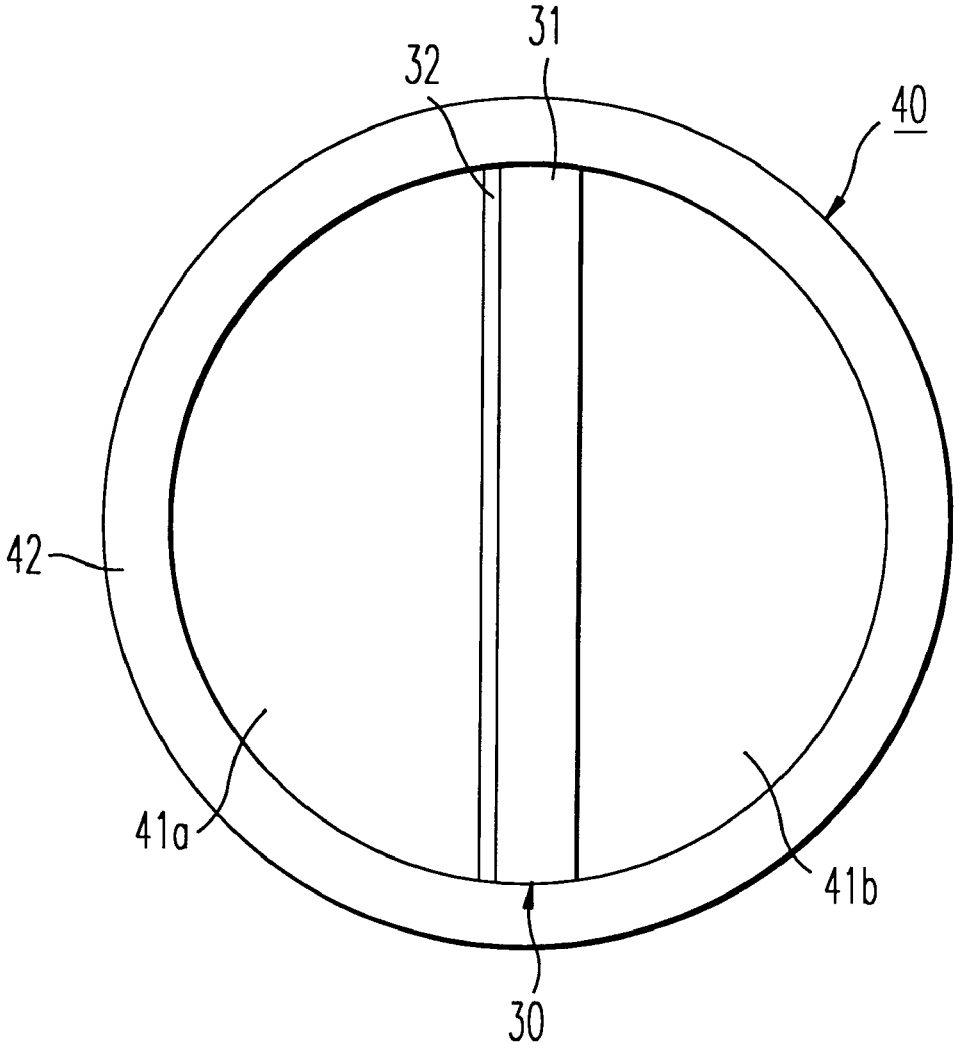
FIG. 12 is a front view of the implemented embodiment shown in FIG. 10.

FIGS. 10–12 show another implemented embodiment of the present invention. Hereinafter, the same numerals are provided for designating same components of the other described embodiments. Namely, in the embodiment of FIGS. 10–12 the antenna apparatus 40 includes the antenna substrate 31, the conduction layer 32, and the planar antenna layer 33 as in the embodiment of FIG. 9.

FIG. 10 shows a plan view and FIGS. 11 and 12 show cross section views of a cylindrical structure of the antenna apparatus 40. FIG. 11 shows a cross section view on a line A-A' as shown in FIG. 10 and FIG. 12 shows a cross section view on a line B-B' as shown in FIG. 10.

Supporting layers 41*a* and 41*b* provide a semi-cylindrical structure. The supporting layers 41*a* and 41*b* are provided for sandwiching each plane of the antenna layer 33 so as to compose a cylindrical structure of the antenna apparatus 40. The supporting layers 41*a* and 41*b* may be composed of dielectric materials, such as foamed polyethylene having a thickness of 3 mm, for obtaining a sufficiently small dielectric ratio so as not to deteriorate antenna characteristics.

A protection member 42 is provided over the cylindrical structure to cover the antenna layer 33 and the supporting layers 41*a* and 41*b*. Favorably, a diameter of the cylindrical structure of the protection member 42 would be planned considering an approximate size of an electric field of the antenna layer 33 thereof. The protection member 42 may be composed by dielectric materials which have a relatively hard structure compared with the antenna layer 33 and the supporting layers 34. For example, the protection member 42 can be provided by PTFE, e.g., TEFLON having a thickness of 1 mm. Therefore, the protection member 42 provides sufficient strength for implementing a compact structure of the tapered slot antenna apparatus 40.

The cylindrical structure of the protection member 42 provides some space surrounding the antenna layer 33, which is approximately coincident with an electric field of the antenna layer 33. Therefore, even if another dielectric device is in the neighborhood of the antenna apparatus 40, characteristics of the antenna apparatus 40 are not deteriorated because the antenna apparatus 40 is provided with some spatial distance from its cylindrical structure. Therefore, an influence from a dielectric material which exists near an outside of the antenna apparatus 40 is reduced. Consequently, the antenna apparatus 40 can provide sufficient antenna characteristics which are not easily deteriorated by an influence of the dielectric material.

The protection member 42 further provides a waveguide portion 43, such as an optical device or reflecting device for a millimeter radiowave. The waveguide portion 43 controls directivity of the planar antenna apparatus.

The antenna layer 30 can be provided with a circuitry for implementing application of a millimeter-wave communication system, for example, a high frequency passive circuit 24 and a high frequency circuit 25. The same manufacturing process of the antenna layer 30 would be able to provide for implementing the high frequency passive circuit 24, such as a balun, a stub, a band-pass filter, an air bridge, etc. Therefore, it would be possible to implement and the high frequency circuit 25, such as a Monolithic Microwave Integrated Circuit (MMIC), and the tapered slot antenna on the same plane of a circuit board in a millimeter wave communication apparatus.

Figure 13:
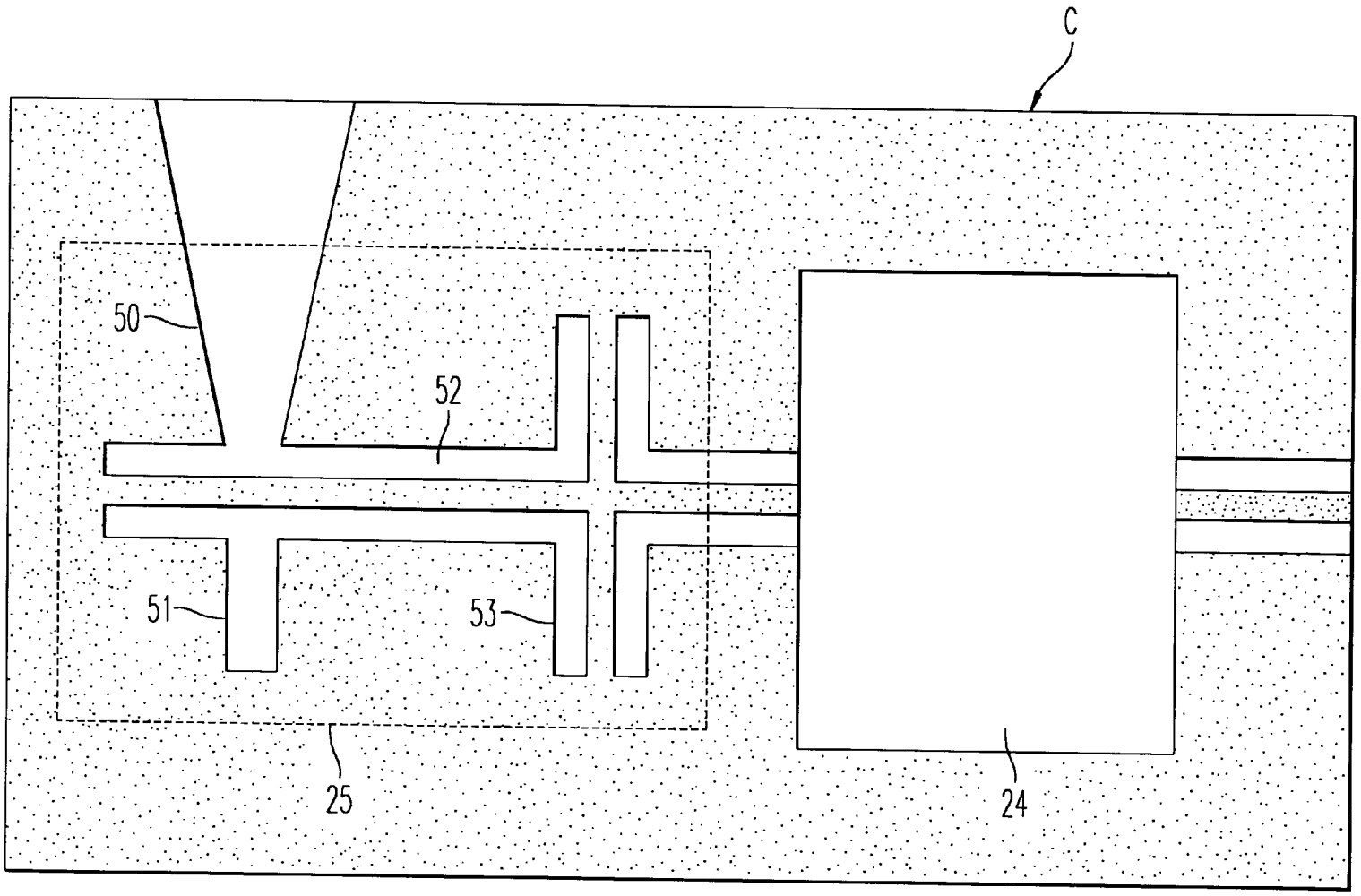
FIG. 13 is a vertical view of the implemented embodiment shown in FIG. 10.

FIG. 13 shows an enlarged view of region C in FIG. 10. In this embodiment, a balun 51 and a matching circuit 53 provide, as examples, implementing the high frequency passive circuit 24. Namely, the high frequency passive circuit 24 includes the balun 51 which connects a slot line 50 of the antenna layer 30 and a coplanar waveguide 52 for translating a signal mode. The matching circuit 53 also provides for an impedance matching between the antenna apparatus 40 and the high frequency circuit 25. The high frequency passive circuit 24 may be implemented as a stub, band-pass filter, air bridge, and the like. According to the present embodiment, a compact millimeter-wave communication system can be implemented so as to provide the high frequency circuit 25, such as the MMIC, on the surface of the antenna layer 30. This construction can be omitted as a component of the circuitry, such as printed circuit board for the high frequency circuit. Such constructions are suitable for implementing compact millimeter-wave communication applications.

As discussed above, the embodiment as shown in FIGS. 1 and 2 is such that a length of the plane antenna 10 may be four times a wavelength of an electromagnetic wave (4 λ). A width of the aperture portion 13*c* may be one wavelength (λ) of the electromagnetic wave, and distances $D_1$, $D_2$ defining distances between end portions of the aperture portion 13*c* (antenna aperture) and the ends of the antenna may be two-wavelengths of the electromagnetic wave (2 λ).

Although the plane antenna 10 has the above characteristics, a dimension of the antenna, more specifically a width of the antenna, is limited as described below. In general, the aperture portion $\mathbf{13}_c$ has a width of an approximately one-wavelength, while the distances $D_1$, $D_2$ between the end portions of the aperture portion 13*c* and the end of the antenna are required to be about two-wavelengths, respectively. If the distances $D_1$, $D_2$ between the end portions of the aperture portion 13*c* and the ends of the antenna are reduced to less than two-wavelengths, the directivity of the plane antenna 60 may deteriorate.

For example, there is described by Ramakrishma Janaswamy and Daniel H. Schaubert, IEEE Trans, Antennas and Propagation, Vol. AP-35, No. 9, 1987,p. 1058–1065, "Analysis of the Tapered Slot Antenna", that, and as described above, when distances between the end portions of the aperture portion and the ends of the antenna are reduced, the directivity of the plane antenna is deteriorated. In addition, it is also described in this publication that when distances between the end portions of the aperture portion and the ends of the antenna are kept constant and the distances between the center of the antenna and the ends of the antenna is three times or more of the wavelength, the directivity of the antenna can be favorably maintained.

Hereinafter, an experimental result is shown relating to a relationship between the distances between the end portions of the aperture portion 13*c* and the ends of the antenna and antenna directivity.

Figure 14A:
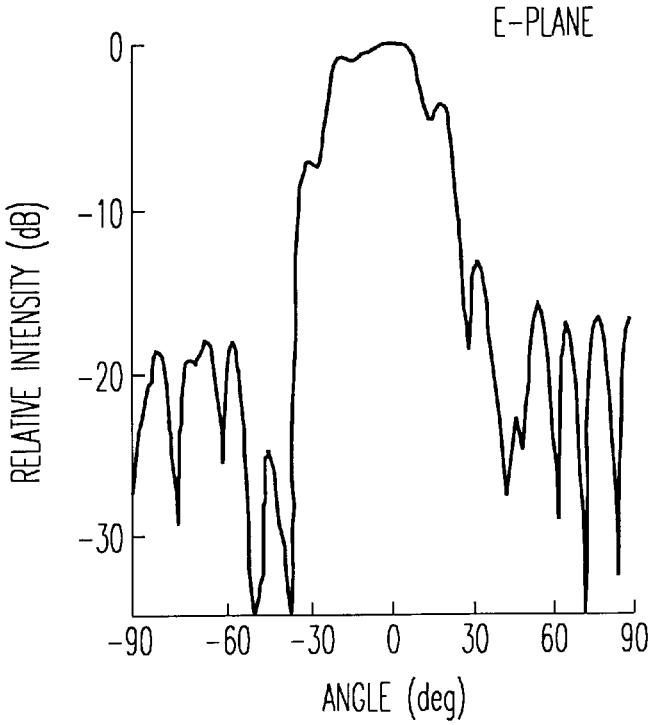
FIG. 14 shows results of measurement of a directivity of a plane antenna shown in FIG. 1, and specifically FIG. 14(*a*) shows results of measurements on an E-plane, and FIG. 14(*b*) shows results of measurements on an H-plane.
Figure 14B:
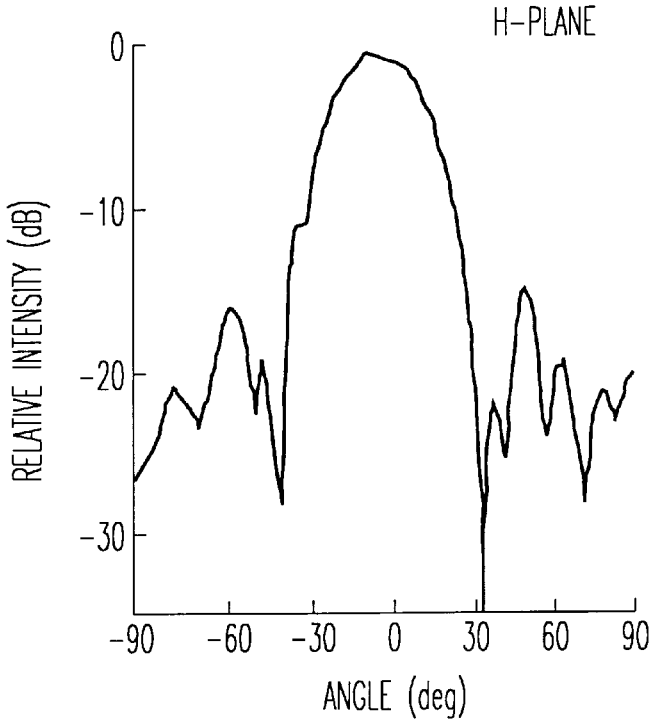

FIGS. 14(*a*) and 14(*b*) show results of measurements of directivity of a plane antenna 10 (the distances $D_1$, $D_2$ between the end portions of the aperture portion 13*c* and the ends of the antenna are two-wavelengths, respectively) shown in FIGS. 1 and 2. FIG. 14(*a*) shows the results of measurements on an E-plane and FIG. 14(*b ) shows the results of measurements on an H-plane.*

Referring to FIGS. 14(*a*) and 14(*b*), since the distances $D_1$, $D_2$ between the end portions of the aperture portion 13*c* and the ends of the antenna are two-wavelengths, respectively, it is appreciated that the plane antenna 10 shown in FIGS. 1 and 2 has a good directivity.

Figure 15:
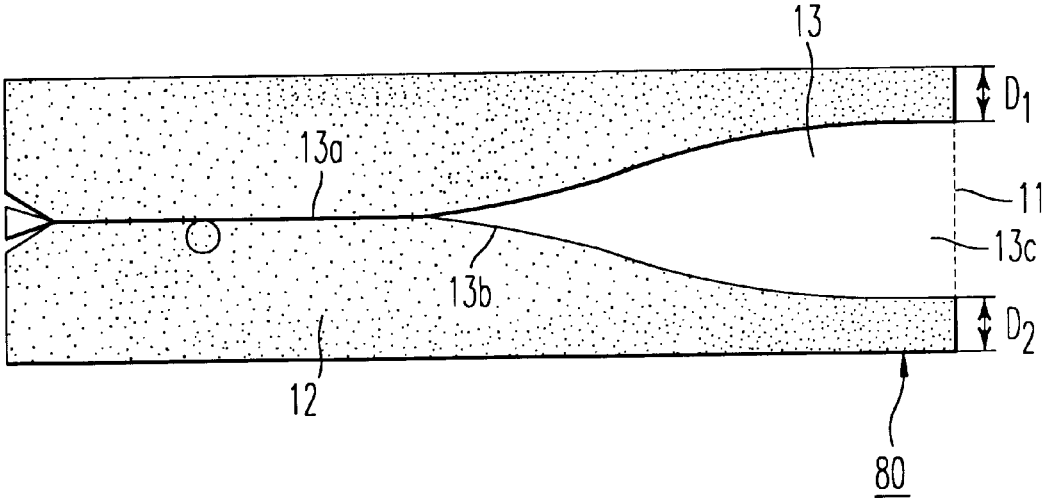
FIG. 15 is a plan view of an antenna according to a further embodiment of the present invention.
Figure 16A:
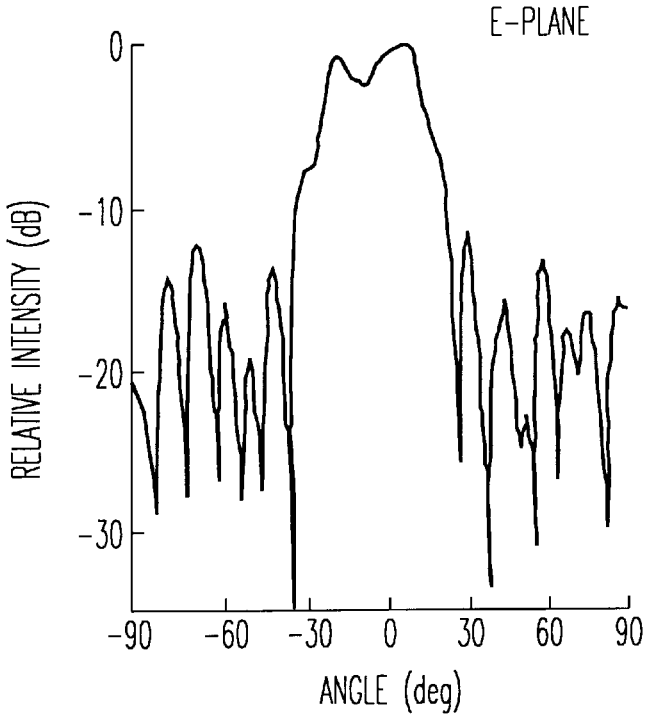
FIG. 16 shows results of measurement of directivity of a plane antenna shown in FIG. 15, and specifically FIG. 16(*a*) shows results of measurements on the E-plane, and FIG. 16(*b*) shows results of measurement on the H-plane.
Figure 16B:
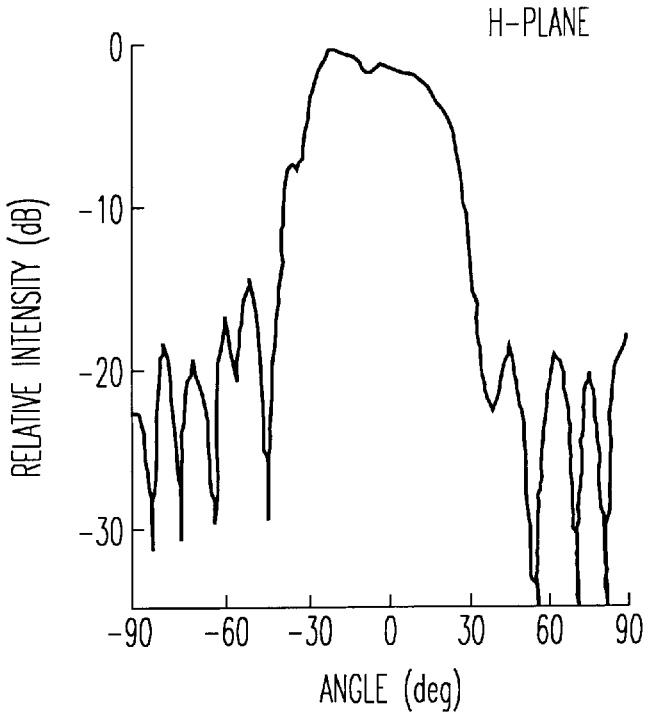

FIG. 15 is a plan view showing another example of a plane antenna 80. In this planar antenna 80 shown in FIG. 15, the distances $D_1$, $D_2$ between the end portions of the aperture portions 13*c* and the ends of the antenna are each 0.5-wavelength, respectively. FIGS. 16(*a*) and 16(*b*) show results of measurements of directivity of the plane antenna 80 shown in FIG. 15. FIG. 16(*a*) shows the results of measurements on the E-plane and FIG. 16(*b*) shows the results of measurements on the H-plane.

When the directivity on the E-plane shown in FIG. 16(*a*) is compared to that in FIG. 14(*a*), a main lobe is split, and a side lobe level becomes higher. The directivity on the H-plane shown in FIG. 16(*b*) becomes slightly broader, compared to that in shown in FIG. 14(*b*).

As mentioned just above, in such a manner, the directivity of the planar antenna 10 shown in FIGS. 1 and 2 in which each of the distances $D_1$, $D_2$ between the end portions of the aperture portion 13*c* and the ends of the antenna is 2λ is compared to that of the planar antenna 80 shown in FIG. 15 in which each of the distances $D_1$, $D_2$ between the end portions of the aperture portion 13*c* and the ends of the antenna is 0.5λ. The results indicate that when the distances $D_1$, $D_2$ between the end portions of the aperture portion 13*c* and the ends of the antenna are reduced, the fact can be confirmed that the directivity of the planar antenna tends to deteriorate.

As described above, according to such planar antennas, the width of the antenna aperture portion is approximately one-wavelength. In order to maintain a good directivity of the planar antenna, the distances between the end portions of the aperture portion and the ends of the antenna are required to be about two-wavelengths. As a result, the antenna has a width of about five-wavelengths. That is to say, in consideration of maintaining directivity, it may be difficult to reduce a size of a planar antenna.

Furthermore, an antenna array is constructed such that a plurality of planar antennas are formed on a same plane. In this case, as a distance between each antenna is reduced, directivity is inclined to deteriorate in the same way and crosstalk between adjacent antennas tends to increase. Therefore, the distance between respective planar antennas constituting the antenna array cannot be reduced. Accordingly, an antenna array including respective planar antennas adjacent to each other may not be able to obtain desired characteristics. On the other hand, when antenna characteristics of respective planar antennas are maintained, a distance between the antennas may not be able to be reduced. Accordingly, it may be difficult to reduce a size of the antenna array.

One further feature of the present invention is to overcome any such problems as to limitations of the dimensions $D_1$ and $D_2$.

Figure 17:
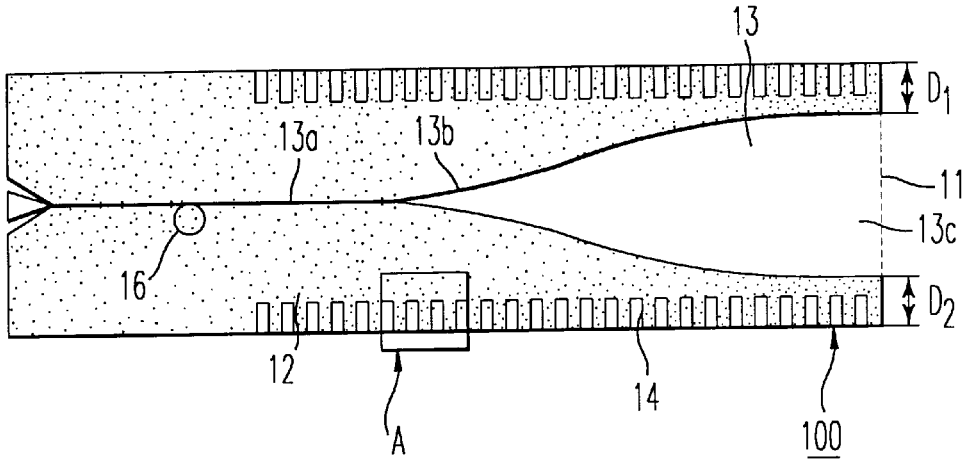
FIG. 17 is a plan view of a plane antenna according to a further embodiment of the present invention.

FIG. 17 is a plan view of a further plane antenna 100 according to an embodiment of the present invention. A plane antenna 100 shown in FIG. 17 is, similarly to the embodiments of FIGS. 1 and 2, provided with a substrate 11 composed of a dielectric and a conductor portion 12 having a tapered slot portion 13 formed on the substrate 11. An electromagnetic wave is radiated from or incident on the tapered slot portion 13. The tapered slot portion 13 includes an input portion 13*a*, a curved portion 13*b* and an aperture portion 13*c*. Furthermore, at respective end portions of the conductor portion 12 located parallel to a radiating direction of the electromagnetic wave is disposed a corrugated structure portion 14 formed by periodically removing the conductor portion 12 on the substrate 11 in rectangular shapes. In FIG. 17, numeral 16 denotes a balun which performs a mode conversion relative to a coplanar line.

This embodiment of FIG. 17 may implement the taper as in the Fermi-Dirac functions as in the embodiments of FIGS. 1–4, although this is not required.

According to the plane antenna 100 of FIG. 17, the substrate 11 may be composed of a sheet of capton having a thickness of 50 μm. A 5-μm-thick copper layer may be laminated on the substrate 11, so that the conductor portion 12 is formed. In addition, the conductor portion 12 may be removed by etching and the like, so that the tapered slot portion 13 is formed. Furthermore, the plane antenna 100 may have a design frequency of 60 GHz. A length of the plane antenna 100 may be 20 mm and a width of the aperture portion 13*c* may be 5 mm. The distances $D_1$, $D_2$ between the end portions of the aperture portions 13*c* and the ends of the antenna may be 2.5 mm, respectively. Furthermore, the corrugated structure portion 14 may be formed by removing the conductor portion 12 in rectangular shapes of 0.4 mm×1 mm at intervals of 0.8 mm.

Figure 18:
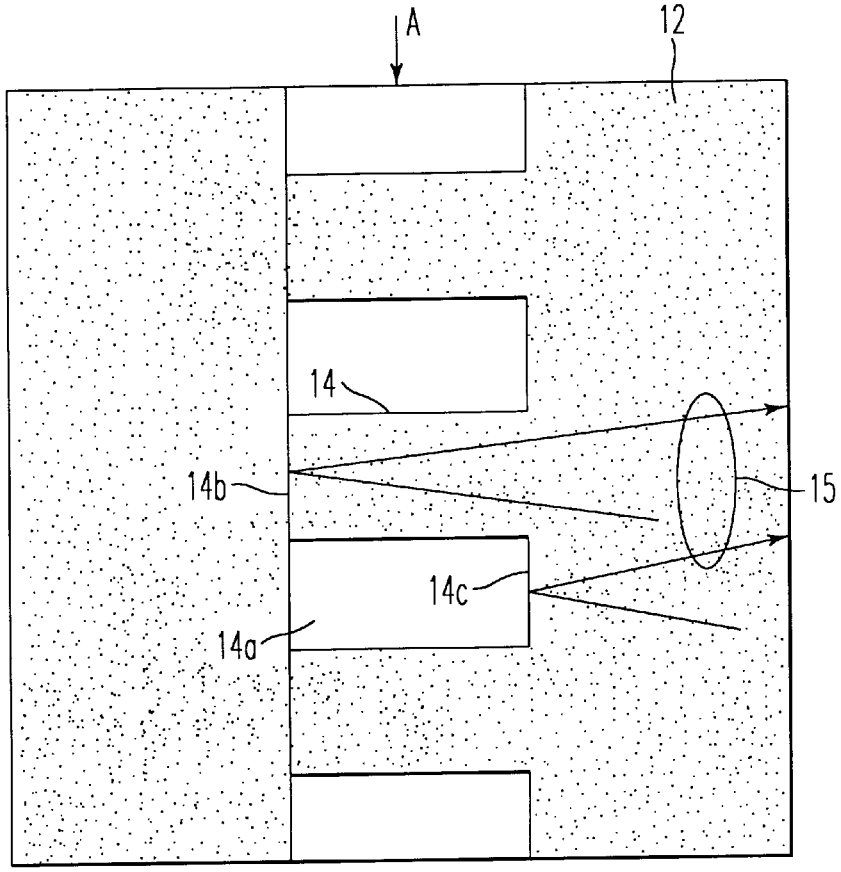
FIG. 18 is an enlarged view of a region A in FIG. 17.

FIG. 18 is an enlarged view of a region A in FIG. 17. Hereinafter, referring to FIG. 18, an action of the corrugated structure portion 14 disposed in the conductor portion 12 of the plane antenna 100 will be described.

As described above, the corrugated structure portion 14 is formed at end portions of the conductor portion 12 located parallel to the radiating direction of the electromagnetic wave. The corrugated structure portion 14 is formed by periodically removing, in rectangular shapes, the conductor portion 12 on the substrate 11. In FIG. 18, numeral 14*a* denotes a region where the conductor portion 12 laminated and formed on the substrate 11 is periodically removed in a rectangular shape. In this region, the substrate 11 alone exists.

As described above, in the plane antenna 100 of FIGS. 17 and 18, as the electromagnetic wave transmitting on a slot line is transmitted in the tapered portion, the slot line mode is transited into a mode in which it is transmitted in a free space, thereby resulting in radiating the electromagnetic wave. In this process, in order to compensate for a discontinuous transition of the modes from the slot line to the free space, a surface wave mode for transmitting on the substrate surface is excited. If the distances $D_1$, $D_2$ between the end portions of the aperture portions 13*c* and the ends of the antenna are sufficiently long, the surface wave is simply transmitted in a direction spaced away from the antenna. Accordingly, a resultant influence of the surface wave can be ignored. On the other hand, if the distances $D_1$, $D_2$ between the end portions of the aperture portions 13*c* and the ends of the antenna are short, the surface wave is reflected at the end portions of the antenna, and the surface wave returns to the antenna portion, whereby the surface wave re-interacts with the electromagnetic wave transmitting in the slot line and free space.

Referring to FIG. 18, numeral 15 denotes the surface wave generated in the antenna portion. The surface wave is reflected at end portions 14*b*, 14*c* of the corrugated structure portion 14. The surface waves reflected at the end portions 14*b*, 14*c* of the corrugated-structure portion 14 are again transmitted toward the antenna portion. Due to an action of the corrugated structure portion 14, the surface waves are offset from each other, so that a strength of the surface wave returning to the antenna portion is reduced. That is to say, the corrugated structure portion 14 is disposed at the end portions of the conductor portion 12 so that a recess is formed at the end portions of the conductor portion. As a result, since the positions of the end portions 14*b*, 14*c* of the corrugated structure portion 14 shown in FIG. 18 are different from each other, the respective surface waves from the antenna are reflected at different positions. Accordingly, the surface waves reflected at the end portions 14*b*, 14*c* of the corrugated structure portion 14 are shifted in phase with respect to each other due to differences of optical path lengths. By appropriately selecting dimensions of the corrugated structure 14, the surface waves thereby offset each other, resulting in reducing their strength.

Accordingly, even if the distances $D_1$, $D_2$ between the end portions of the aperture portion 13*c* and the ends of the antenna are short, the corrugated structure portion 14 provides for preventing characteristics of the plane antenna 10 from deteriorating.

Figure 19A:
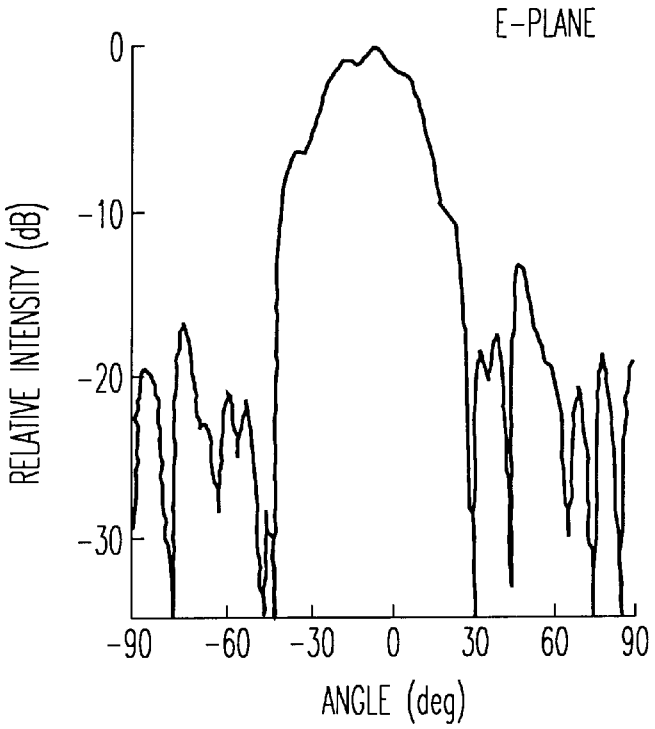
FIG. 19 shows results of measurements of directivity of the plane antenna shown in FIGS. 17 and 18, and specifically FIG. 19(*a*) shows results of measurements on an E-plane, and FIG. 19(*b*) shows results of measurement on an H-plane.
Figure 19B:
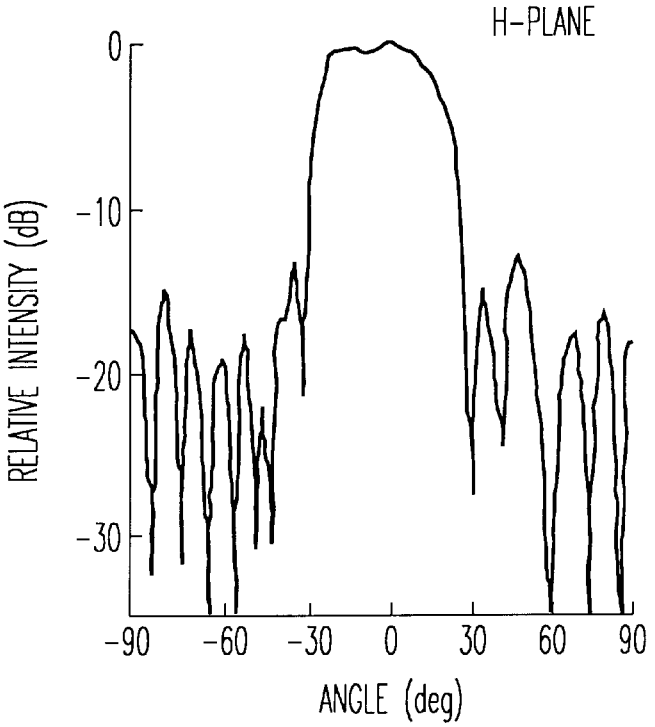

Next, results of measurements of directivity of the plane antenna 100 according to the embodiment of FIGS. 17 and 18 will now be described. FIGS. 19(*a*) and 19(*b*) show results in a case that directivity of the plane antenna 100 shown in FIG. 17 is measured at 60 GHz. FIG. 19(*a*) shows results of measurements on an E-plane and FIG. 19(*b*) shows results of measurements on an H-plane.

In a plane antenna, when the distances $D_1$, $D_2$ between the end portions of the aperture portion 13*c* and the ends of the antenna are short, a main lobe of the directivity on the E-plane is split. Accordingly, since a side lobe level becomes higher (see FIG. 16(*a*)), there is such a problem that the directivity on the H-plane becomes slightly broader (see FIG. 16(*b*)). On the other hand, referring to FIGS. 19(*a*) and 19(*b*), in the plane antenna 100 according to the embodiment of the FIGS. 17 and 18, it is appreciated that the above problem is improved. Accordingly, it is possible to obtain results showing an effectivity of utilizing the corrugated structure portion 14 as in the present invention.

In such a manner, according to the plane antenna 100 of the embodiment of FIGS. 17 and 18, the corrugated structure portion 14 is disposed at respective end portions of the conductor portion 12 located parallel to the radiating direction of the electromagnetic wave. Accordingly, even if the distances $D_1$, $D_2$ between the end portions of the aperture portion 13*c* and the ends of the antenna are short, it is possible to reduce a strength of a surface wave reflected at the antenna end, resulting in preventing directivity of the plane antenna from deteriorating.

Figure 20:
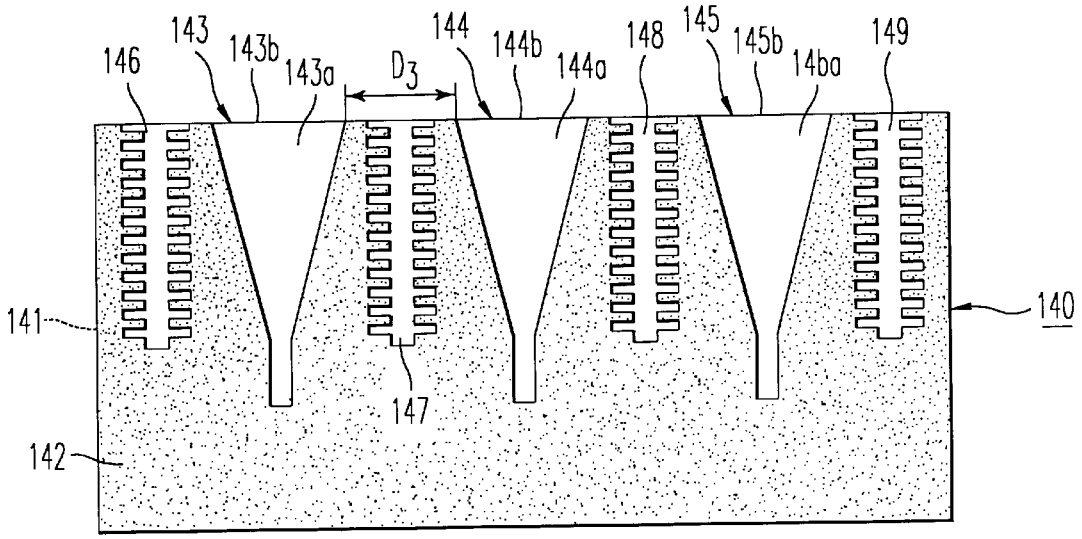
FIG. 20 is a plan view of an antenna array according to a further embodiment of the present invention.

FIG. 20 is a plan view of an antenna array according to a further embodiment of the present invention. An antenna array 140 shown in FIG. 20 is composed of a plurality of plane antennas 143 to 145 formed on a same plane. The antenna array 140 includes a substrate 141 composed of a dielectric and a conductor portion 142 having a plurality of tapered slot portions 143*a* to 145*a* formed on the substrate 141. Electromagnetic waves are radiated from the tapered slot portions 143*a* to 145*a*. Furthermore, between each plane antenna 143 to 145 of the conductor portion 142 are formed slits 146 to 149 in which a corrugated structure, similar as disclosed in FIGS. 17 and 18, is disposed.

In the array antenna according to this further embodiment, the substrate 141 may be composed of a sheet of capton having a thickness of 50 $\mu$m. A 5-$\mu$m-thick copper layer may be laminated on the substrate 141, so that the conductor portion 142 is formed. Each of the plane antennas 143 to 145 is formed on the substrate 141. Furthermore, each plane antenna 143 to 145 may have a design frequency of 60 GHz. A length of each plane antenna may be 20 mm and a width of aperture portions 143*b* to 145*b* may be 5 mm. The distance $D_3$ between the end portions of the aperture portions 143*b* to 145*b* may be 5 mm. Additionally, each of the slits 146 to 149 disposed between each antenna 143 to 145 may be 100 $\mu$m in width and 20 mm in length. The corrugate having an area of 0.4 mm×1 mm may be formed, at intervals of 0.8 mm, at both sides of the slits 146 to 149.

Next, in the antenna array 140 according to this further embodiment, the action of the slits 146 to 149 having the corrugated structure will be described.

As described above, in an antenna array provided with a plurality of plane antennas on a same plane, when a distance between each plane antenna is shortened, there is a problem that crosstalk between adjacent antennas may be generated and directivity of each antenna deteriorates. In order to reduce crosstalk between adjacent antennas, the slit can simply be disposed between each antenna. However, when the slit is disposed between each antenna, the surface wave from the antenna portion is reflected at the slit portion. The reflected surface wave returns to the antenna portion, whereby directivity of each antenna is deteriorated.

Accordingly, in the antenna array 140 of this further embodiment of FIG. 20, the slits 146 to 149 are disposed between each of the plane antennas 143 to 145, and each of the slits 146 to 149 has the corrugated structure as discussed above. Accordingly, the reflected surface waves reflected at the slits 146 to 149 are offset from each other, so that a strength of the surface wave can be reduced. That is, the corrugated structure is disposed in the slits 146 to 149, thereby resulting in forming a recess at the end portion of the slits 146 to 149. Accordingly, the surface waves reflected at the recess portions in the corrugated structure are shifted, relative to each other, in phase due to differences of optical path lengths. Accordingly, the surface waves offset each other, resulting in reducing their strength.

Furthermore, since the slits 146 to 149 are disposed, crosstalk between adjacent plane antennas 143 to 145 can be reduced.

In such a manner, according to the antenna array of this further embodiment, the slits 146 to 149 are provided with the corrugated structure. Accordingly, even if a distance between each of the plane antennas 143 to 145 is shortened so that the plane antennas 143 to 145 are adjacent to each other, a strength of a surface wave reflected at the antenna end can be reduced. Crosstalk between adjacent antennas can be reduced, and deterioration of directivity of each antenna can be avoided. Consequently, it is possible to prevent characteristics of respective plane antennas constituting the antenna array from deteriorating.

Although in FIG. 20 the antenna array 140 is provided with three plane antennas, the number of the plane antennas is clearly not limited to three.

Figure 21:
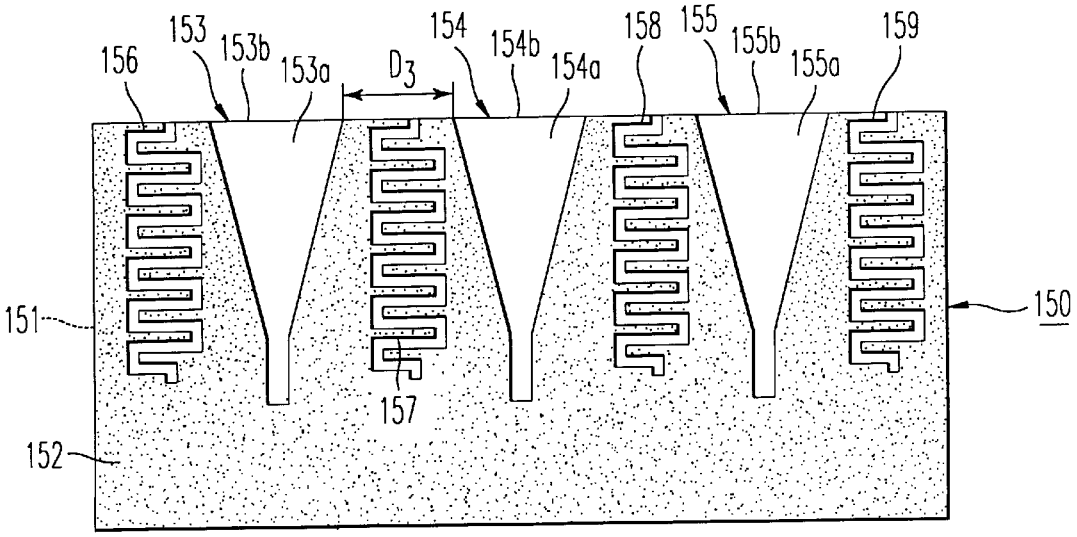
FIG. 21 is a plan view of an antenna array according to a further embodiment of the present invention.

FIG. 21 is a plan view of an antenna array according to a further embodiment of the present invention. An antenna array 150 shown in FIG. 21 is composed of a plurality of plane antennas 153 to 155 formed on a same plane. The antenna array 150 includes a substrate 151 composed of a dielectric and a conductor portion 152 having a plurality of tapered slot portions 153*a* to 155*a* formed on the substrate 151. Electromagnetic waves are radiated from or incident on the tapered slot portions 143*a* to 145*a*. Furthermore, between each plane antenna 153 to 155 of the conductor portion 152 are formed slits 156 to 159 in which the corrugated structure is disposed. The corrugated structure disposed in the slits 156 to 159 is different from the corrugated structure of the above-noted embodiment of FIG. 20, in that this further corrugated structure has a telescopic structure. The corrugated structure is such a telescopic structure, whereby the width of the slits 156 to 159 can be reduced, compared to that of the slits 146 to 149 of the above-noted embodiment of FIG. 20.

According to the antenna array 150 of this further embodiment of FIG. 21, the substrate 151 may be composed of a sheet of capton having a thickness of 50 $\mu$m. A 5-$\mu$m-thick copper layer may be laminated on the substrate 151, so that the conductor portion 152 is formed. Each of the plane antennas 153 to 155 is formed on the substrate 151. Each plane antenna 153 to 155 may have a design frequency of 60 GHz. A length of each plane antenna may be 20 mm and a width of aperture portions 153*b* to 155*b* may be 5 mm. The distance $D_3$ between the end portions of the aperture portions 153*b* to 155*b* may be 5 mm. Additionally, each of the slits 156 to 159 disposed between each antenna 153 to 155 may be 100 $\mu$m in width. The slits 156 to 159 are snaking forward so that the corrugate may have an area of 0.3 mm×1 mm and may be arranged at intervals of 0.8 mm.

In the antenna array 150 according to this further embodiment of FIG. 21, the action of the slits 156 to 159 having the corrugated structure is the same as described in the embodiment of FIG. 20. Accordingly, the description is omitted.

In such a manner, according to the antenna array of this further embodiment of FIG. 21, the slits 156 to 159 having the corrugated structure are disposed. Accordingly, even if the distance between each of the plane antennas 153 to 155 is shortened so that the plane antennas 153 to 155 are adjacent to each other, a strength of a surface wave reflected at the antenna end can be reduced. Crosstalk between the adjacent antennas can also be reduced, and deterioration of the directivity of each antenna can be prevented. As a result, it is possible to prevent characteristics of respective plane antennas constituting the antenna array from deteriorating.

Although in FIG. 21 the antenna array 150 is provided with three plane antennas, the number of the plane antennas is clearly not limited to three.

As described above, according to further features of the present invention, a plane antenna is provided with a conductor portion having a slot line and a corrugated structure at respective end portions located parallel to a radiating direction of an electromagnetic wave. Accordingly, even if distances between end portions of the aperture portion and ends of the antenna are short, a strength of a surface wave reflected at the antenna ends can be reduced. Thereby, deterioration of directivity of each plane antenna can be prevented.

Furthermore, according to further features of the present invention, an antenna array is provided with a plurality of slot lines and a conductor portion having a slit in which a corrugated structure is disposed between each slot line. Accordingly, even if distances between each of the plane antennas is shortened so that the plane antennas are adjacent to each other, a strength of a surface wave reflected at antenna ends can be reduced. Crosstalk between adjacent antennas can also be reduced, and deterioration of directivity of each antenna can be prevented. As a result, it is possible to prevent characteristics of respective plane antennas constituting the antenna array from deteriorating.

This application is based on Japanese patent applications No. 8-181687, 8-181688, and 8-340387, the contents of which are hereby incorporated by reference.

Obviously, numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A planar antenna apparatus for radiating or receiving a radiowave, having a wavelength of one centimeter or less, of a radio communication system, comprising:

a planar substrate;

an electric conduction layer which connects said planar substrate to a circuitry of said radio communication system, said electric conduction layer providing a tapered slot pattern for radiating and receiving the radiowave, wherein said tapered slot pattern is described by a following function:

$$y = \frac{a}{1 + e^{bx+c}}$$

wherein x is a variable of position coordinates on a radiation direction of said planar antenna apparatus, and a, b, and c are predetermined constants.

2. A planar antenna apparatus for radiating or receiving a radiowave, having a wavelength of one centimeter or less, of a radio communication system, comprising:

a planar substrate;

an electric conduction layer which connects said planar substrate to a circuitry of said radio communication system, said electric conduction layer providing a tapered slot pattern for radiating and receiving the radiowave, wherein said tapered slot pattern is described by a following function:

$$y = \frac{a}{1 + e^{bx+c}} + dx$$

wherein x is a variable of position coordinates on a radiation direction of said planar antenna apparatus, and a, b, c and d are predetermined constants.

3. A planar antenna apparatus for radiating or receiving a radiowave of a radio communication system, comprising:

an antenna layer including a dielectric layer, and which provides a tapered pattern for radiating and receiving the radiowave;

supporting layers which sandwich said antenna layer, wherein said supporting layers are composed of materials which have a lower dielectric ratio than said dielectric layer of said antenna layer; and protection layers which sandwich said supporting layers, wherein said protection layers are composed by dielectric materials and which are further harder materials than said supporting layers.

4. A planar antenna apparatus as recited in claim 3, wherein said antenna layer is composed of a combination of an antenna substrate of a dielectric film and an electric conduction layer.

5. A planar antenna apparatus as recited in claim 3, wherein said supporting layers are composed of a foam dielectric material.

6. A planar antenna apparatus as recited in claim 3, wherein said protection layers are composed of PTFE.

7. A planar antenna apparatus as recited in claim 3, wherein said protection layers further provide a wave control device which controls directivity of said planar antenna apparatus.

8. A planar antenna apparatus as recited in claim 3, wherein said protection layers provide a cylindrical structure.

9. A planar antenna apparatus as recited in claim 3, wherein said antenna layers further include circuitry of said radio communication system on a surface.

10. A plane antenna having a structure in which a slot width of a slot line is widened in tapering for radiating an electromagnetic wave in a progressive direction of said slot line, comprising:

a conductor portion having said slot line; and a corrugated structure at respective end portions of said conductor portion located parallel to a radiating direction of said electromagnetic wave.

11. A plane antenna as recited in claim 10, wherein said slot pattern is tapered using a Fermi-Dirac distribution function.

12. A plane antenna as recited in claim 10, wherein a wavelength of said radiowave is one centimeter or less.

13. A plane antenna as recited in claim 12, wherein said tapered slot pattern is described by a following function:

$$y = \frac{a}{1 + e^{bx+c}}$$

wherein x is a variable of position coordinates on a radiation direction of said planar antenna apparatus, and a, b, and c are predetermined constants.

14. A plane antenna as recited in claim 12, wherein said tapered slot pattern is described by a following function:

$$y = \frac{a}{1 + e^{bx+c}} + dx$$

wherein x is a variable of position coordinates on a radiation direction of said planar antenna apparatus, and a, b, c and d are predetermined constants.

15. An antenna array including, on a same plane, a plurality of plane antennas having a structure in which a slot width of a slot line is widened in tapering for radiating an electromagnetic wave in a progressive direction of said slot line, comprising:

a conductor portion having a plurality of said slot lines; and a slit in which a corrugated structure is disposed between each of said slot lines.

16. A plane antenna as recited in claim 15 wherein said slot pattern is tapered using a Fermi-Dirac distribution function.

17. A plane antenna as recited in claim 15, wherein a wavelength of said radiowave is one centimeter or less.

18. A planar antenna apparatus as recited in claim 17, wherein said tapered slot pattern is described by a following function:

$$y = \frac{a}{1 + e^{bx+c}}$$

wherein x is a variable of position coordinates on a radiation direction of said planar antenna apparatus, and a, b, and c are predetermined constants.

19. A planar antenna apparatus as recited in claim 17, wherein said tapered slot pattern is described by a following function:

$$y = \frac{a}{1 + e^{bx+c}} + dx$$

wherein x is a variable of position coordinates on a radiation direction of said planar antenna apparatus, and a, b, c and d are predetermined constants.

* * * * *